US006131345A

United States Patent [19]

Pelusio

[11] Patent Number: 6,131,345

[45] Date of Patent: Oct. 17, 2000

[54] GARAGE DOOR WINDOW FACADE

[76] Inventor: Frank A. Pelusio, 1756 Belleair Rd., Clearwater, Fla. 33756

[21] Appl. No.: 09/259,213

[22] Filed: Mar. 1, 1999

[51] Int. Cl.[7] ..... E06B 3/66

[52] U.S. Cl. ..... 52/204.59; 52/208; 52/204.6; 52/204.61; 52/784.1; 428/13; 428/131

[58] Field of Search ..... 52/208, 204.59, 52/204.6, 204.61, 784.1, 199, 473; 40/557, 580, 594, 595; 156/71; 428/13, 34, 38, 68, 131, 134, 137, 138

[56] References Cited

U.S. PATENT DOCUMENTS

| | | | |
|---|---|---|---|
| 2,100,111 | 11/1937 | Stonebraker . | |
| 2,160,762 | 5/1939 | Stevenburg | 52/208 |
| 2,193,207 | 3/1940 | Rosen | 52/204.59 |
| 2,814,895 | 12/1957 | Flam | 40/126 |
| 2,927,355 | 3/1960 | Rasmussen | 52/235 |
| 3,024,880 | 3/1962 | Burmeister . | |
| 3,064,380 | 11/1962 | Baut et al. | 41/21 |
| 3,076,294 | 2/1963 | Schiessl | 50/267 |
| 3,440,786 | 4/1969 | Weaver . | |
| 3,815,263 | 6/1974 | Oberwager . | |
| 4,180,934 | 1/1980 | Cohen | 40/580 |
| 4,207,869 | 6/1980 | Hart | 52/473 |
| 4,411,855 | 10/1983 | Fiebig, Jr. et al. | 264/219 |
| 4,563,846 | 1/1986 | Webb | 52/208 |
| 4,949,521 | 8/1990 | Riegelman et al. | 52/456 |
| 5,123,211 | 6/1992 | Schlicht et al. | 52/202 |
| 5,239,800 | 8/1993 | Edwards et al. | 52/455 |
| 5,251,392 | 10/1993 | McManigal . | |
| 5,265,360 | 11/1993 | Reiss et al. . | |
| 5,426,879 | 6/1995 | Hecker . | |
| 5,440,847 | 8/1995 | Butler | 52/208 |
| 5,497,588 | 3/1996 | Martin et al. . | |
| 5,516,387 | 5/1996 | Hoffmann | 156/70 |
| 5,622,019 | 4/1997 | Dorough, Jr. . | |
| 5,782,051 | 7/1998 | LaVoie | 52/199 |

*Primary Examiner*—Carl D. Friedman
*Assistant Examiner*—Dennis L. Dorsey
*Attorney, Agent, or Firm*—Anton J. Hopen; Smith & Hopen, P.A.

[57] ABSTRACT

A garage door window facade is constructed from a flat panel having a plurality of apertures shaped to resemble small window openings. In a first embodiment, a dark-colored backing is positioned behind the flat panel and is visible through the apertures to create the illusion of a window. In a second embodiment, a layer of transparent or translucent material is sandwiched between the flat panel and the dark-colored backing to give an enhanced appearance of a window opening. The assembly is rigidly secured to a standard garage door by bolts, screws, adhesive or the like to give the illusion that the garage door has windows. The apparatus does not protrude far from the exterior surface of the garage door so that the apparatus does not interfere with the opening or closing of the garage door. An aesthetic molding may be positioned around the peripheral edges of the assembly for framing purposes, or the flat panel may be provided with built-in molding.

15 Claims, 2 Drawing Sheets

GARAGE DOOR WINDOW FACADE

BACKGROUND OF THE INVENTION

1. Field of the Invention

The present invention relates generally to building construction, and more particularly to a window facade for use on garage doors.

2. Description of the Prior Art

Many homeowners wish to remodel the exterior of their homes, but prefer to do so without spending large sums of money. One of the most visible structures in many homes is the garage door because it is often placed in the front of the home. One very popular form of garage door remodeling includes the installation of small, decorative windows. These windows break the monotony of a large garage door and make it look more like the rest of the house.

Under current technology, a homeowner desiring to upgrade a garage door has but two choices: to purchase a new garage door of the type having factory-installed windows, or to retrofit windows into the existing garage door. The former option is the most expensive solution to the problem, and in most cases results in wasting an otherwise good garage door.

Many garage doors are constructed of a plurality of horizontal panels hinged together whereby the door may be rolled up and down a set of laterally spaced apart, parallel tracks. Windows can be installed within one or more panels by cutting apertures within the panel and installing a decorative overlay assembly such as described in U.S. Pat. No. 5,497,588 to Martin et al. ('588 patent) which is incorporated herein by reference. The '588 patent describes a decorative window system for an opening in a garage door wherein a decorative overlay and a windowpane are mounted directly over an opening in a garage door using an anchor mechanism.

However, many homeowners are hesitant to cut openings in their garage doors, especially if they desire the aesthetic effect of a window but have no utilitarian need for windows in their garage door.

Moreover, many garage doors provide insulating capabilities and cutting through a panel may compromise its insulating properties.

Accordingly, many homeowners wish to provide a more pleasing aesthetic appearance to their garage door without incurring significant expense and without sacrificing the structural integrity of their existing garage door.

One method for creating the appearance of garage door windows is to paint an array of dark-colored shapes on the door to create the desired illusion. However, homeowners may not wish to undergo the chores of handling paints, brushes and the associated cleaning. Furthermore, painting an array of consistent looking windows requires great skill and labor. More importantly, since paint provides a two-dimensional surface, the illusion is poor and does not give the appearance of real windows.

Consequently, there is a need in the art for an inexpensive garage door window facade that is easily constructed and installed.

There is a further need in the art for a garage door window facade that provides the illusion of real windows.

There is a further need in the art for a garage door window facade that is resistant to the elements of weather and retains its appearance over time.

However, in view of the prior art in at the time the present invention was made, it was not obvious to those of ordinary skill in the pertinent art how the identified needs could be fulfilled.

SUMMARY OF THE INVENTION

The present invention solves significant problems in the art by providing a garage door window facade that is easy to install, attractive in appearance, inexpensive to manufacture and resistant to various weather conditions.

Generally described, the present invention provides a garage door window facade including a substantially flat opaque panel having one or more window-shaped apertures formed therein which are arranged in a decorative fashion. In a first embodiment, a dark-colored backing is fastened to the flat panel in underlying relation thereto whereby the backing is visible through the apertures of the flat panel, thereby creating the illusion of a true window. The combination of the flat panel and backing are rigidly secured to one another and to a garage door by any suitable means such as standard screws or adhesive.

A suitable frame may be added by securing an aesthetic molding about the periphery of the panel and backing. Alternatively, the panel may be provided with an integrally-formed molding at the time the panel is made.

The aesthetic effect of the first embodiment is enhanced by adding a coating of a glossy material, such as polyurethane, to the surface of the backing which is visible through the openings formed in the panel.

In a second, preferred embodiment, a flat transparent or translucent material is sandwiched between the flat panel and the dark-colored backing to further enhance the window illusion. The sandwiched material may comprise glass, acrylic or any other clear or translucent material. The material may also be frosted or patterned in a decorative fashion.

As the garage door window facade is mounted externally, and therefore exposed to various weather conditions, it is preferable that the materials are non-corrosive, resistant to color change and inexpensive to manufacture. In a preferred embodiment, the flat panel and backing are constructed of polyvinyl chloride foam or a similar polymer material.

Accordingly, it is an object of the present invention to provide an aesthetically-pleasing garage door having the appearance of windows formed therein without incurring the expense of installing real windows.

Another object is to provide a window facade that may be installed without cutting openings into a pre-existing garage door.

Still another object is to provide a window facade that may be easily installed by a layperson using bolts, screws, adhesives or the like.

Another object is to provide a garage door window facade that is resistant to the effects of long-term exposure to the elements.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
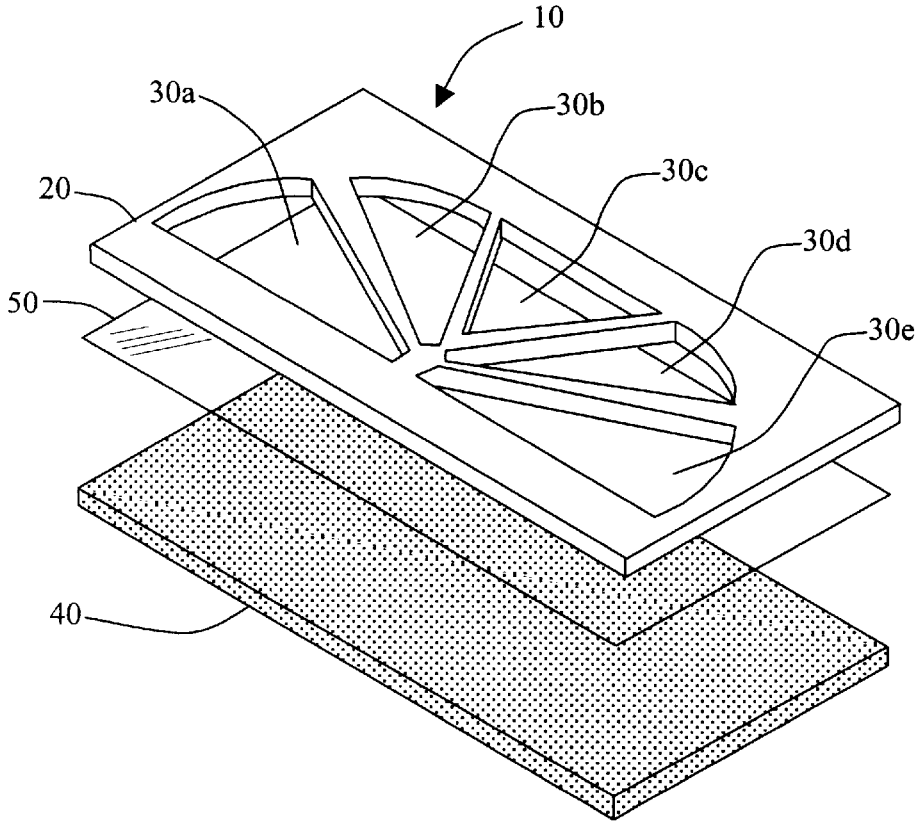
FIG. 1 is an exploded perspective view of a preferred of the embodiment of the garage door window facade according to the invention.

Referring initially to FIG. 1, it will there be seen that an illustrative embodiment of the present invention is denoted by the reference number 10 as a whole.

A substantially flat panel 20 having a plurality of window-shaped apertures 30*a–e* arranged in a decorative fashion is formed of a non-corrosive, weather resistant material. Preferably, flat panel 20 is constructed of polyvinyl chloride foam which maintains its color even when subjected to long-term exposure to ultraviolet light. Flat panel 20 may be constructed using a thermoplastic injection mold system.

Openings 30*a–e* are preferably formed by a router in a well-known way.

Figure 3:
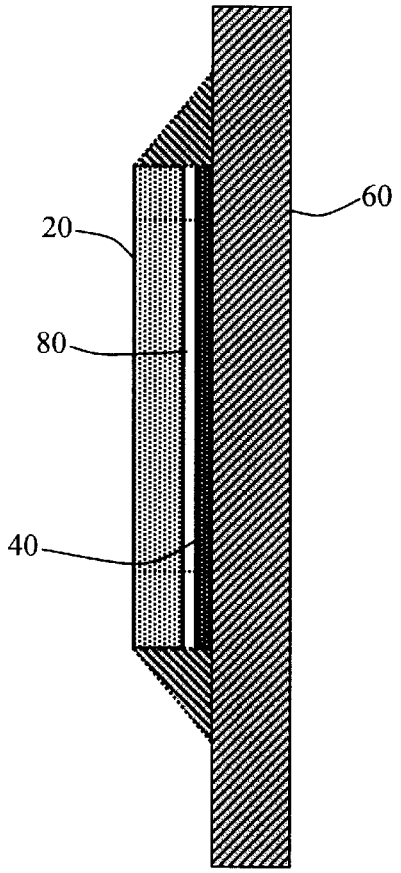
FIG. 3 is a cross-sectional elevational view of an alternative embodiment of the garage door window facade according to the invention.

In a first embodiment, depicted in FIG. 3, backing 40 is fastened to flat panel 20 in underlying relation thereto so that backing 40 is visible through apertures 30*a–e*. Preferably, backing 40 is dark or black in color, but may be any other color that provides the illusion of depth. In addition, it is preferred that backing 40 be constructed of non-corrosive, weather resistant material, such as polyvinyl chloride as recommended for flat panel 20. Backing 40 may have perfectly flat surfaces, or it may be textured to enhance the illusion of depth.

A layer of polyurethane or other glossy material 80 may also be added to the visible surface of backing 40 to help create the illusion of conventional garage door windows.

Figure 2:
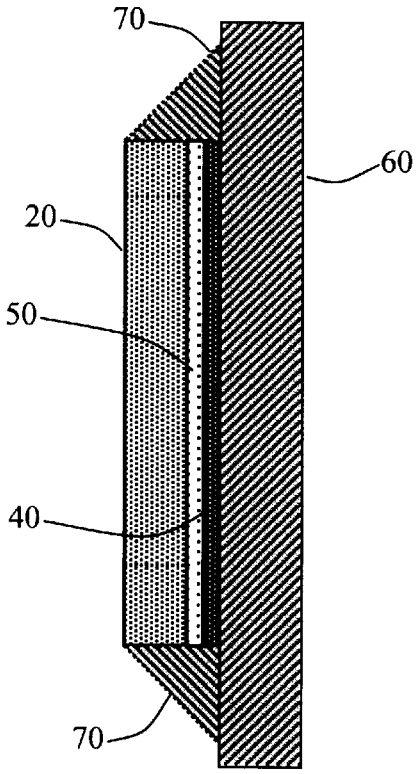
FIG. 2 is a cross-sectional elevational view of the preferred embodiment of the garage door window facade according to the invention.

In the preferred embodiment, depicted in FIGS. 1 and 2, a layer of transparent or translucent material 50 is sandwiched between flat panel 20 and backing 40 to further enhance the window illusion. The transparent or translucent material may comprise glass, acrylic or any other suitable clear or translucent material. The transparent or translucent material may also be frosted or patterned in a decorative fashion.

A coating of a glossy material such as urethane may be applied to the visible surface of the backing in this preferred embodiment, just as in the first embodiment, but such gloss is not needed in this embodiment.

FIG. 2 is a cross-sectional side view of the preferred embodiment wherein the combination of flat paneling 20, layer of transparent or translucent material 50, and backing 40 is rigidly fixed to a standard garage door 60. A decorative molding 70 is mounted about the perimeter of flat panel 20. Alternatively, panel 20 may be extruded with integrally formed molding 70.

As mentioned earlier, FIG. 3 illustrates the first embodiment of the invention; glossy coating 80 covers backing 40, there being no transparent or translucent material 50 in this embodiment.

Figure 4:
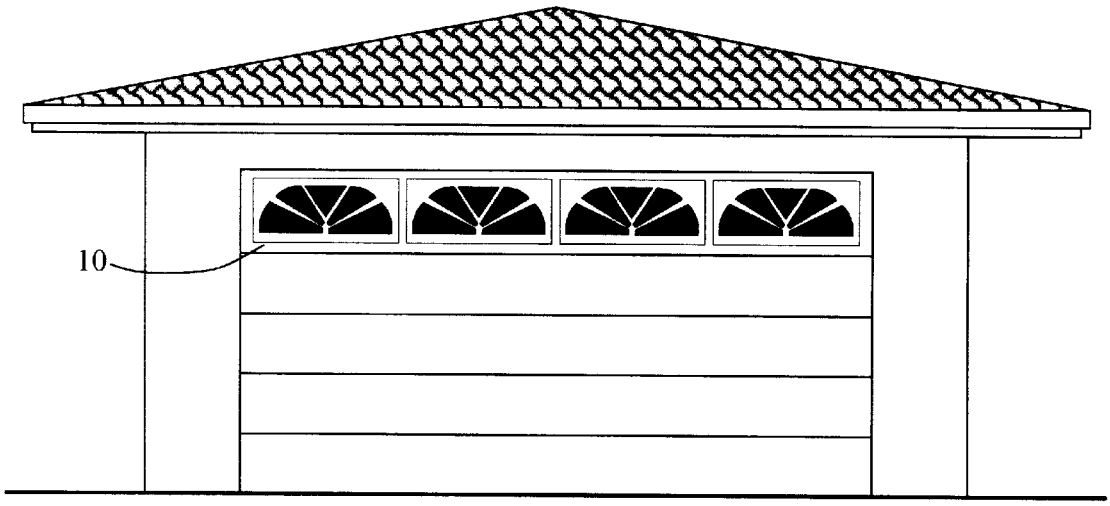
FIG. 4 is a front elevational view of the garage door window facade installed on a typical garage door according to the invention.

FIG. 4 illustrates the invention as installed on a typical garage door. A casual inspection of the garage door will not reveal that the windows are not real. The garage door equipped with the novel invention has a greatly enhanced aesthetic appeal and the homeowner has not been required to cut holes in the garage door to retrofit windows thereto or to incur the expense of a new garage door.

Moreover, since panel 20, transparent or translucent material 50 and backing 40 are thin in structure, the novel assembly is almost flush with the garage door surface and does not interfere with the opening and closing of the door.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A door and window facade, said facade comprising:

a substantially flat opaque panel having a least one window-shaped aperture formed therein;

a backing fastened to said flat panel in underlying relation thereto so that said backing is visible through said at least one window-shaped aperture; and a mounting means rigidly securing said flat panel and backing to said door thereby creating an illusion of a true window without requiring an aperture to be formed within said door wall.

2. The a door and window facade of claim 1, wherein said backing has a dark color.

3. The a door and window facade of claim 1, further comprising a glossy overcoat applied to said backing.

4. The a door and window facade of claim 1, further comprising a layer of transparent material sandwiched between said flat panel and said backing.

5. The a door and window facade of claim 1, further comprising a layer of translucent material sandwiched between said flat panel and said backing.

6. The a door and window facade of claim 4, wherein said layer of transparent material is constructed of glass.

7. The a door and window facade of claim 4, wherein said layer of transparent material is constructed of acrylic.

8. The a door and window facade of claim 1, wherein said flat panel is constructed of polyvinyl chloride.

9. The window facade of claim 4, further comprising a molding disposed around peripheral edges of said flat panel, said transparent material and said backing in framing relation thereto to enhance the aesthetic appearance of the window facade.

10. The window facade of claim 5, further comprising a molding disposed around peripheral edges of said flat panel, said translucent material and said backing in framing relation thereto to enhance the aesthetic appearance of the window facade.

11. The a door and window facade of claim 1, wherein said backing is constructed of polyvinyl chloride.

12. The a door and window facade of claim 1, further comprising a molding disposed around peripheral edges of said flat panel and said backing in framing relation thereto to enhance the aesthetic appearance of the window facade.

13. The a door and window facade of claim 5, wherein said layer of translucent material is constructed of glass.

14. The a door and window facade of claim 5, wherein said layer of translucent material is constructed of acrylic.

15. A door and window facade, said facade comprising:

a substantially flat panel constructed of polyvinyl chloride having a least one window-shaped aperture formed therein;

a dark colored backing constructed of polyvinyl chloride and fastened to said flat panel in underlying relation thereto so that said dark colored backing is visible through said at least one window-shaped aperture; and a glossy overcoat applied to said dark colored backing; and a mounting means rigidly securing said flat panel and backing to said door thereby creating an illusion of a true window without requiring an aperture to be formed within said door wall.

* * * * *